US007189130B2

(12) United States Patent
Vega

(10) Patent No.: US 7,189,130 B2
(45) Date of Patent: Mar. 13, 2007

(54) SWIM CAP

(76) Inventor: Ada C. Vega, 232 W. 123rd St., #1, New York, NY (US) 10027

( * ) Notice: Subject to any disclaimer, the term of this patent is extended or adjusted under 35 U.S.C. 154(b) by 109 days.

(21) Appl. No.: 10/984,659

(22) Filed: Nov. 10, 2004

(65) Prior Publication Data

US 2006/0096001 A1 May 11, 2006

(51) Int. Cl.
*B63C 9/08* (2006.01)
*A42B 1/12* (2006.01)

(52) U.S. Cl. ..... 441/124; 2/68

(58) Field of Classification Search ..... 441/124; 2/67, 68

See application file for complete search history.

(56) References Cited

U.S. PATENT DOCUMENTS 655,481 A * 8/1900 Evans ..... 601/12
2,072,483 A 3/1937 Naundorf
3,321,772 A 5/1967 Arps et al.
3,329,970 A * 7/1967 Damsz ..... 2/68
3,381,305 A * 5/1968 Buzzelli ..... 2/68
3,394,406 A 7/1968 Bergens
3,510,880 A * 5/1970 Horst ..... 2/68
4,281,417 A 8/1981 Valentine
5,349,702 A 9/1994 Runckel
D437,472 S 2/2001 Ruscitti et al.

* cited by examiner

*Primary Examiner*—Jesús D. Sotelo

(57) ABSTRACT

A cap includes a flexible body having a dome shape for conveniently conforming to a swimmer's head. The body includes an outer layer and an inner layer spaced from the outer layer such that a cavity is defined therebetween. The inner layer is provided with a plurality of conduits and a strap is integral with the outer layer and travels about a circumference of the cap. The present invention further includes a mechanism for effectively removing the stagnant air such that the inner layer can effectively maintain surface contact with the swimmer's hair and cooperate with the strap for preventing water from entering beneath the cap.

15 Claims, 4 Drawing Sheets

SWIM CAP

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a swim cap and, more particularly, to a swim cap for effectively preventing water from contacting a swimmer's hair during aquatic activities.

2. Prior Art

The problem with prior known caps, such as swimming caps, is that they are not entirely water-tight along the length of the margin of the cap that fits against the head. This is because of the irregular shape of the human head and neck, and due to changes in shape caused by the tensing and relaxing of muscles during use of the cap. More specifically, swimming caps have not created a water-tight seal against the head in regions of the head located below and directly adjacent the ears of the head. Furthermore, problems have arisen in obtaining an adequate seal in regions extending across the nape of the neck because of the flexing of muscles in this area during swimming. For example, during the crawl stroke, the neck muscles alternately flex and relax as the head is turned from side to side.

Accordingly, a need remains for a swim cap in order to overcome the above-noted shortcomings. The present invention satisfies such a need by providing a swim cap that is comfortable to wear, easy to use, convenient and durable in construction. Such a swim cap firmly rests against a user's head by removing the air thereunder, thus resulting in a superior water tight seal to those seen in conventional swim caps.

BRIEF SUMMARY OF THE INVENTION

In view of the foregoing background, it is therefore an object of the present invention to provide a swim cap. These and other objects, features, and advantages of the invention are provided by a swim cap for effectively preventing water from contacting a swimmer's hair during aquatic activities.

The cap includes a flexible body removably positionable about a swimmer's head. Such a body has a dome shape for conveniently conforming to the swimmer's head such that a swimmer's hair can be effectively tucked therebeneath.

The body includes an outer layer formed from water-impermeable material and an inner layer spaced from the outer layer such that a cavity is defined therebetween for allowing air to pass therealong. Such an inner layer is provided with a plurality of conduits for advantageously withdrawing stagnant air trapped between the swimmer's head and the lower layer after the cap is positioned about the swimmer's head, wherein the cavity is collapsible when the swimmer firmly presses the cap downwardly about the head.

The conduits preferably are selectively spaced along the inner layer and travel about an outer surface of the swimmer's head.

A strap integral with the outer layer is included and travels about a circumference of the cap for advantageously assisting the swimmer to tightly position the cap about the swimmer's head such that water can be effectively prevented from soaking the swimmer's hair during swimming activities. Such a strap may be formed from elastic material. Of course, alternate suitable materials may be used as a strap as is well known to a person skilled in the art.

The present invention further includes a mechanism for effectively removing the stagnant air such that the inner layer can effectively maintain surface contact with the swimmer's hair and cooperate with the strap for preventing water from entering beneath the cap. The removing mechanism preferably includes an outlet port including a valve attached thereto. Such an outlet port is in fluid communication with the cavity such that the swimmer can effectively channel the stagnant air outwardly and away from the cap by toggling the valve between open and closed positions.

The removing mechanism may further include an air pump including a control switch and a hollow tube that has opposed end portions connected thereto and attached to the cap. Such a pump assists a user to depressurize the cavity by removing the stagnant air trapped therein. The pump is preferably removably attachable to the outlet port such that a user may advantageously participate in swimming activities without having to transport the pump.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
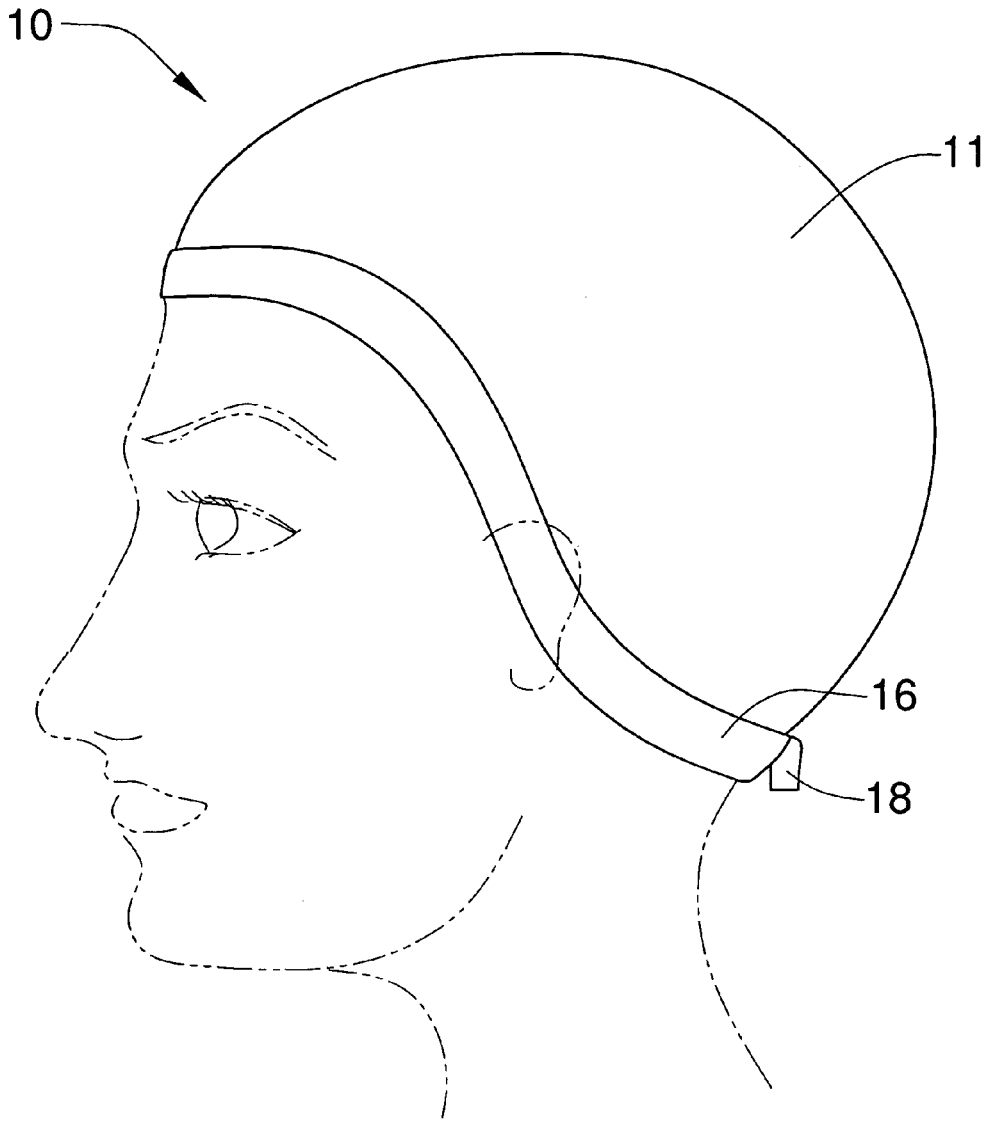
FIG. 1 is a side elevational view showing a swim cap for effectively preventing water from contacting a swimmer's hair during aquatic activities, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–4 by the reference numeral 10 and is intended to protect a swim cap. It should be understood that the apparatus 10 may be used to protect an individual's hair from moisture in many different types of situations and should not be limited to use only during swimming.

Referring initially to FIG. 1, the apparatus 10 includes a flexible body 11 removably positionable about a swimmer's head. Such a body 11 has a dome shape for conveniently conforming to the swimmer's head such that a swimmer's hair can be effectively tucked therebeneath without becoming wet.

Figure 3:
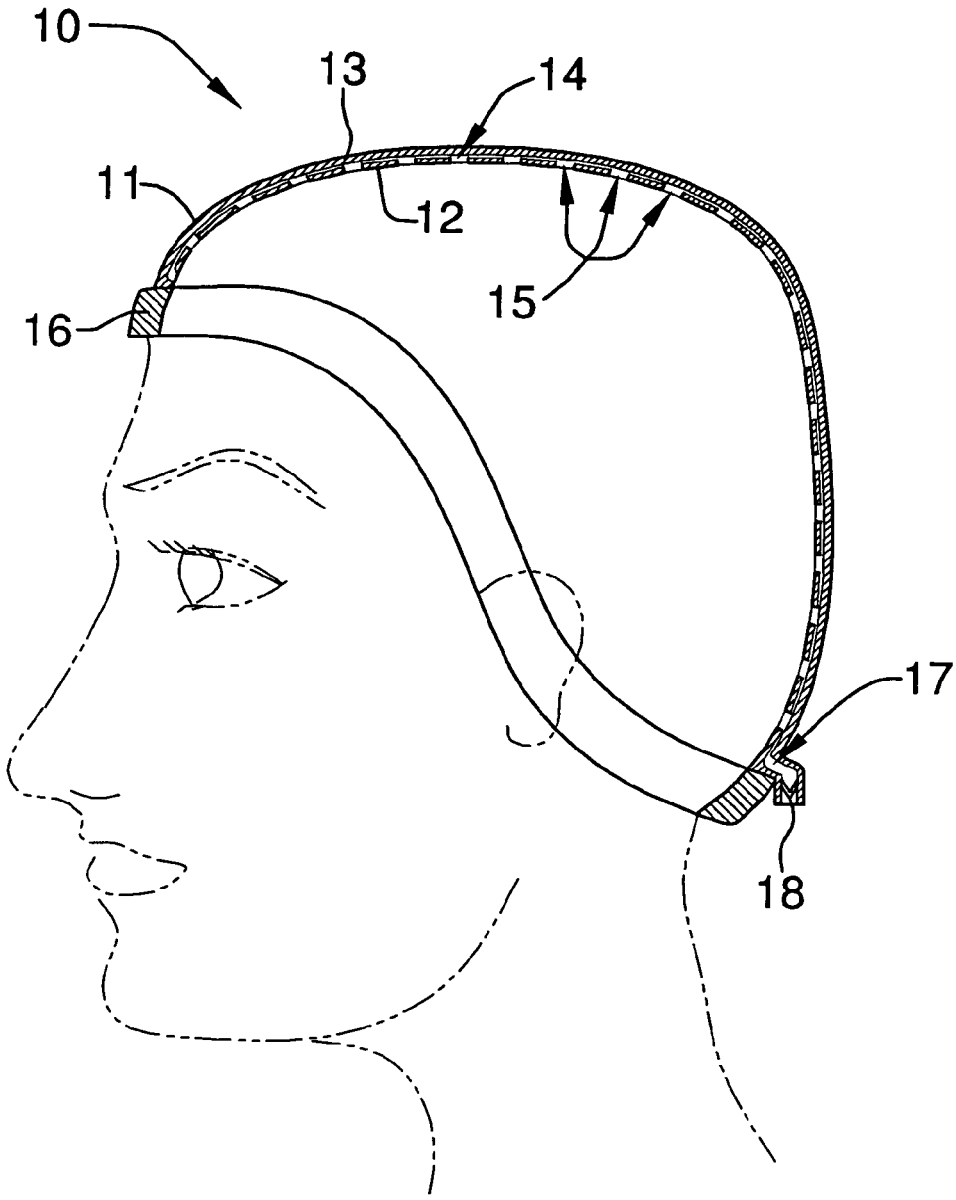
FIG. 3 is a cross-sectional view of the apparatus shown in FIG. 1, taken along line 3—3.

Referring to FIG. 3, the body 11 includes an outer layer 13 formed from water-impermeable material and an inner layer 12 spaced from the outer layer 13 such that a cavity 14 is defined therebetween for allowing air to pass therealong. Such an inner layer 12 is provided with a plurality of conduits 15 for advantageously withdrawing stagnant air trapped between the swimmer's head and the lower layer 12 after the cap 10 is positioned about the swimmer's head, wherein the cavity 14 is collapsible when the swimmer firmly presses the cap 10 downwardly about the head. The conduits 15 preferably are selectively spaced along the inner layer 12 and travel about an outer surface of the swimmer's head. This feature allows the cap 10 to form a watertight seal about a swimmer's head. Such a tight fitting cap 10 may be preferable for competitive swimmers because the tighter the cap 10 fits to the head the less friction it causes in the water, thus allowing the swimmer to swim faster.

Referring to FIGS. 1, 2, 3 and 4, a strap 16 is integral with the outer layer 13 and travels about a circumference of the cap 10 for advantageously assisting the swimmer to tightly position the cap 10 about the swimmer's head such that water can be effectively prevented from soaking the swimmer's hair during swimming activities. Such a strap 16 may be formed from elastic material. Of course, alternate suitable materials may be used as a strap 16 as well known to a person skilled in the art.

Figure 2:
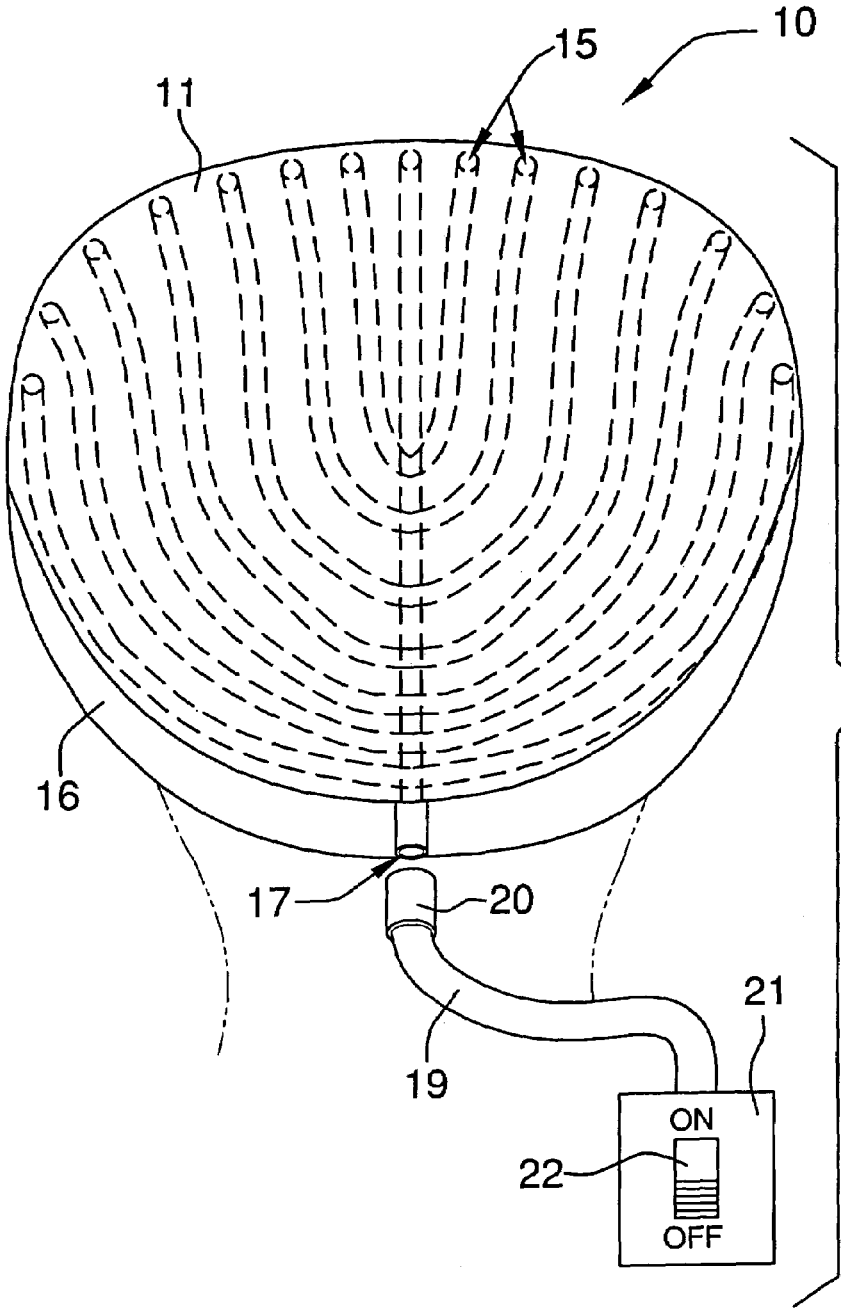
FIG. 2 is a rear elevational view of the apparatus shown in FIG. 1.
Figure 4:
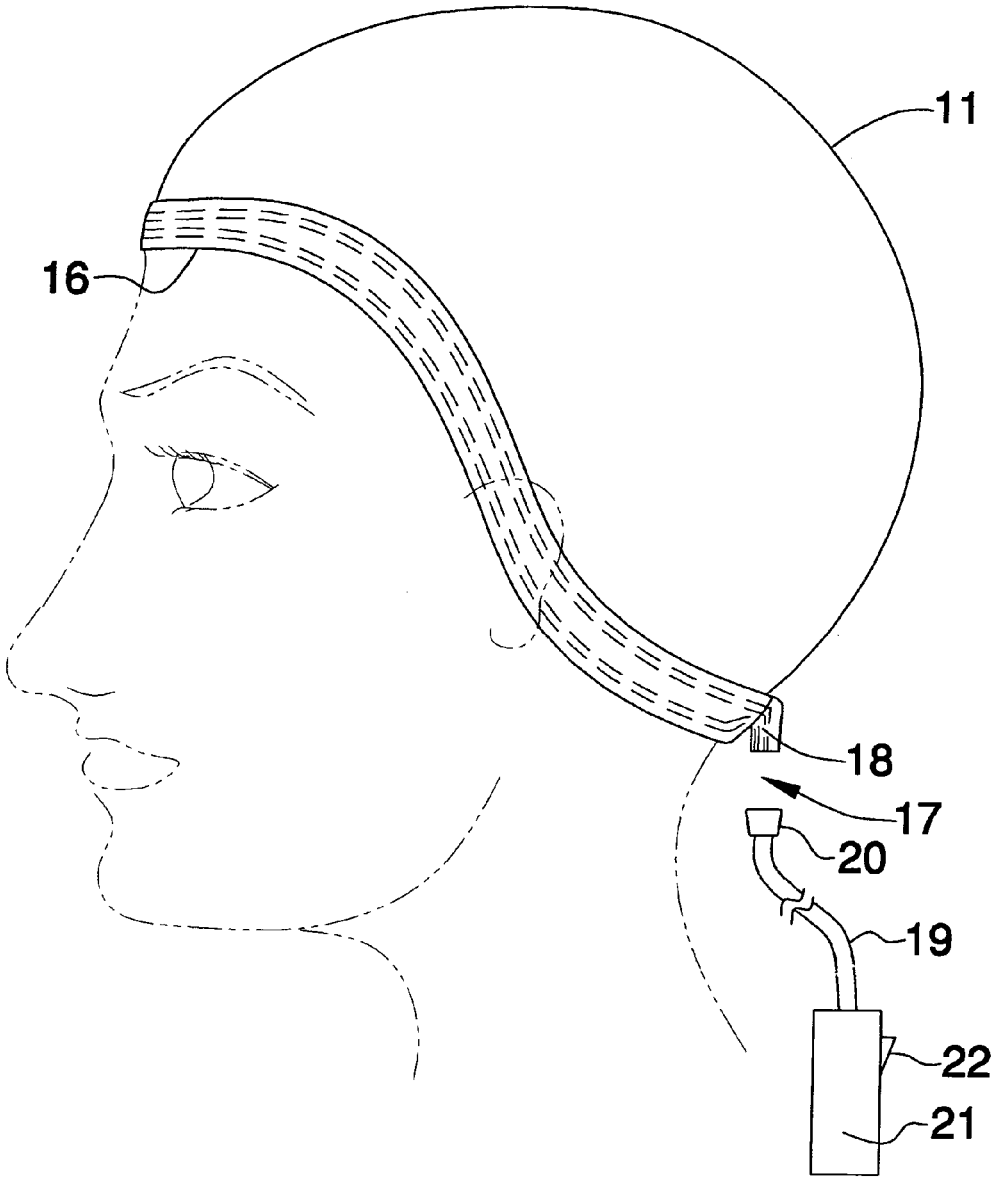
FIG. 4 is a side elevational view of the apparatus shown in FIG. 1 showing the plurality of conduits within the strap.

Referring to FIGS. 2, 3 and 4, the present invention further includes a mechanism for effectively removing the stagnant air such that the inner layer 12 can effectively maintain surface contact with the swimmer's hair and cooperate with the strap 16 for preventing water from entering beneath the cap. The removing mechanism preferably includes an outlet port 17 including a valve 18 attached thereto. Such an outlet port 17 is in fluid communication with the cavity 14 such that the swimmer can effectively channel the stagnant air outwardly and away from the cap 10 by toggling the valve 18 between open and closed positions.

Referring to FIGS. 2 and 4, the removing mechanism may further include an air pump 21 including a control switch 22 and a hollow tube 19 that has opposed end portions 20 connected thereto and attached to the cap. Such a pump assists a user to depressurize the cavity 14 by removing the stagnant air trapped therein. The pump 21 is preferably removably attachable to the outlet port 17 such that a user may advantageously participate in swimming activities without having to transport the pump 21. Such a pump 21 advantageously allows an individual to remove air trapped in the cavity 14 more rapidly than by simply pressing on the cap 10.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A swim cap for effectively preventing water from contacting a swimmer's hair during aquatic activities, said cap comprising:

a body removably positionable about a swimmer's head, said body being sized and shaped for conforming to the swimmer's head such that a swimmer's hair can be effectively tucked therebeneath, said body comprising an outer layer formed from water-impermeable material, an inner layer spaced from said outer layer such that a cavity is defined therebetween for allowing air to pass therealong, said inner layer being provided with a plurality of conduits for withdrawing stagnant air trapped between the swimmer's head and said lower layer after said cap is positioned about the swimmers head, a strap integral with said outer layer and traveling about a circumference of said cap for assisting the swimmer to tightly position said cap about the swimmer's head such that water can be effectively prevented from soaking the swimmer's hair during swimming activities, and means for effectively removing the stagnant air such that said inner layer can maintain surface contact with the swimmer's hair and cooperate with said strap for preventing water from entering beneath said cap, wherein said removing means comprises an outlet port including a valve attached thereto, said outlet port being in fluid communication with the cavity such that the swimmer can channel the stagnant air outwardly and away from said cap by toggling said valve between open and closed positions.

2. The cap of claim 1, wherein said conduits are selectively spaced along said inner layer and travel about an outer surface of the swimmer's head.

3. The cap of claim 1, wherein said strap is formed from elastic material.

4. The cap of claim 1, wherein said removing means comprises:

an air pump including a control switch and a hollow tube having opposed end portions connected thereto and attached to said cap, said pump for assisting a user to depressurize the cavity by removing the stagnant air trapped therein.

5. The cap of claim 1, wherein said pump is removably attachable to said outlet port such that a user may participate in swimming activities without having to transport said pump.

6. A swim cap for effectively preventing water from contacting a swimmer's hair during aquatic activities, said cap comprising:

a flexible body removably positionable about a swimmers head, said body having a dome shape for conforming to the swimmer's head such that a swimmer's hair can be effectively tucked therebeneath, said body comprising an outer layer formed from water-impermeable material, an inner layer spaced from said outer layer such that a cavity is defined therebetween for allowing air to pass therealong, said inner layer being provided with a plurality of conduits for withdrawing stagnant air trapped between the swimmer's head and said lower layer after said cap is positioned about the swimmer's head, a strap integral with said outer layer and traveling about a circumference of said cap for assisting the swimmer to tightly position said cap about the swimmer's head such that water can be effectively prevented from soaking the swimmer's hair during swimming activities, and means for effectively removing the stagnant air such that said inner layer can maintain surface contact with the swimmer's hair and cooperate with said strap for preventing water from entering beneath said cap, wherein said removing means comprises an outlet port including a valve attached thereto, said outlet port being in fluid communication with the cavity such that the swimmer can channel the stagnant air outwardly and away from said cap by toggling said valve between open and closed positions.

7. The cap of claim 6, wherein said conduits are selectively spaced along said inner layer and travel about an outer surface of the swimmer's head.

8. The cap of claim 6, wherein said strap is formed from elastic material.

9. The cap of claim 6, wherein said removing means comprises:

an air pump including a control switch and a hollow tube having opposed end portions connected thereto and attached to said cap, said pump for assisting a user to depressurize the cavity by removing the stagnant air trapped therein.

10. The cap of claim 6, wherein said pump is removably attachable to said outlet port such that a user may participate in swimming activities without having to transport said pump.

11. A swim cap for effectively preventing water from contacting a swimmer's hair during aquatic activities, said cap comprising:

a flexible body removably positionable about a swimmer's head, said body having a dome shape for conforming to the swimmer's head such that a swimmer's hair can be effectively tucked therebeneath, said body comprising an outer layer formed from water-impermeable material, an inner layer spaced from said outer layer such that a cavity is defined therebetween for allowing air to pass therealong, said inner layer being provided with a plurality of conduits for withdrawing stagnant air trapped between the swimmer's head and said lower layer after said cap is positioned about the swimmer's head, wherein the cavity is collapsible when the swimmer firmly presses said cap downwardly about the head, a strap integral with said outer layer and traveling about a circumference of said cap for assisting the swimmer to tightly position said cap about the swimmer's head such that water can be effectively prevented from soaking the swimmer's hair during swimming activities, and means for effectively removing the stagnant air such that said inner layer can maintain surface contact with the swimmer's hair and cooperate with said strap for preventing water from entering beneath said cap;

wherein said removing means comprises an outlet port including a valve attached thereto, said outlet port being in fluid communication with the cavity such that the swimmer can channel the stagnant air outwardly and away from said cap by toggling said valve between open and closed positions.

12. The cap of claim 11, wherein said conduits are selectively spacing along said inner layer and travel about an outer surface of the swimmer's head.

13. The cap of claim 11, wherein said strap is formed from elastic material.

14. The cap of claim 11, wherein said removing means comprises:

an air pump including a control switch and a hollow tube having opposed end portions connected thereto and attached to said cap, said pump for assisting a user to depressurize the cavity by removing the stagnant air trapped therein.

15. The cap of claim 11, wherein said pump is removably attachable to said outlet port such that a user may participate in swimming activities without having to transport said pump.

* * * * *